US012179895B2

(12) United States Patent
Benson

(10) Patent No.: US 12,179,895 B2
(45) Date of Patent: Dec. 31, 2024

(54) EXPLOSIVE CONTAINER

(71) Applicant: TETAC, Inc, Monterey, CA (US)

(72) Inventor: Mark Benson, Carmel, CA (US)

(73) Assignee: TETAC Inc., Monterey, CA (US)

( * ) Notice: Subject to any disclaimer, the term of this patent is extended or adjusted under 35 U.S.C. 154(b) by 624 days.

(21) Appl. No.: 17/229,730

(22) Filed: Apr. 13, 2021

(65) Prior Publication Data

US 2021/0380209 A1 Dec. 9, 2021

Related U.S. Application Data

(60) Provisional application No. 63/009,694, filed on Apr. 14, 2020.

(51) Int. Cl.
*B63G 7/02* (2006.01)

(52) U.S. Cl.
CPC ..... *B63G 7/02* (2013.01)

(58) Field of Classification Search
CPC ..... F42D 5/04; F42D 3/00; F42D 3/02; F42D 1/00; F42B 3/00; F42B 1/00; F42B 22/00; F42B 22/02; F42B 22/10; F42B 3/02; B63G 7/02
USPC ..... 102/314, 315, 318, 319, 322, 331, 402, 102/403
See application file for complete search history.

(56) References Cited

U.S. PATENT DOCUMENTS

| | | | | | |
|---|---|---|---|---|---|
| 4,641,581 | A * | 2/1987 | Weickert | F42B 3/08 | 102/315 |
| 4,815,384 | A * | 3/1989 | Ringel | F42B 3/08 | 102/307 |
| 4,970,957 | A * | 11/1990 | Backstein | B63G 7/02 | 89/1.13 |
| 5,042,387 | A * | 8/1991 | Backstein | B63G 7/02 | 89/1.13 |
| 7,000,545 | B2 * | 2/2006 | Sansolo | F42B 3/00 | 102/305 |
| 8,091,479 | B1 * | 1/2012 | Jakaboski | F42B 33/062 | 102/305 |
| 9,534,874 | B2 * | 1/2017 | Alford | F42B 1/028 | |
| 2008/0173204 | A1 * | 7/2008 | Anderson | F42B 3/26 | 102/318 |
| 2009/0235837 | A1 * | 9/2009 | Scheid | F42B 12/204 | 102/331 |

FOREIGN PATENT DOCUMENTS

| | | | | |
|---|---|---|---|---|
| GB | 2517173 A * | 2/2015 | | B63G 7/02 |
| GB | 2548728 A * | 9/2017 | | F42B 1/02 |
| GB | 2591139 A * | 7/2021 | | B63G 7/02 |
| WO | WO-2019168469 A1 * | 9/2019 | | B65G 33/10 |

* cited by examiner

*Primary Examiner* — Jonathan C Weber
(74) *Attorney, Agent, or Firm* — Gorman IP Law, APC; Susan W. Gorman

(57) ABSTRACT

An underwater explosive container to house explosives and explosive tools for deployment on bottom mines, moored mines, and underwater explosive devices that can be positioned via a remotely operated vehicle or a diver for neutralizing, rendering safe, or detonating the intended target and methods of building and utilizing the underwater explosive container.

11 Claims, 13 Drawing Sheets

EXPLOSIVE CONTAINER

CROSS-REFERENCE TO RELATED APPLICATIONS

This Nonprovisional application claims priority under 35 U.S.C. § 119(e) on U.S. Provisional Application No. 63/009,694 filed on Apr. 14, 2020, the entire contents of which are hereby incorporated by reference in its entirety.

STATEMENT REGARDING FEDERALLY SPONSORED RESEARCH OR DEVELOPMENT

This invention was made with government support under Contract number N6833518C0163 awarded by NAVSEA. The government has certain rights in the invention.

TECHNICAL FIELD

Embodiments of the present invention relate to the technical field of bomb disrupting and deactivating devices. More particularly, the embodiments of the invention are directed to an apparatus and method for remotely over pressurizing or puncturing mine casings to neutralize mines and underwater hazardous explosive devices.

BACKGROUND OF THE INVENTION

A naval mine is a self-contained explosive device placed in the water to destroy ships, submarines, or maritime related targets. Naval mines are typically deployed into the water column and remain in place until they are triggered by the approach of or contact with a target. Naval mines are used defensively to protect coastal shores, shipping routes, and/or to prevent access from enemy forces. Naval mines can also be used in an offensive manner. Such examples include the blocking of a harbor or shipping channel.

Naval mines are relatively inexpensive, although more sophisticated mines can cost millions of dollars, be equipped with several kinds of sensors, and deliver a warhead by rocket or torpedo. The flexibility and cost-effectiveness of naval mines and underwater hazardous explosive devices make mines attractive weapons to the less powerful belligerent in asymmetric warfare.

Several types of naval mines exist. A bottom mine is a type of naval mine that is usually air dropped to its location and lies on the surface of the ocean floor. The explosive and detonating mechanism is contained in a metal or plastic shell and is usually deployed in less than 60 meters of water. These types of mines can use several kinds of instruments to detect an enemy, which is usually a combination of acoustic, magnetic, and pressure sensors, or more sophisticated optical shadows or electro potential sensors. Moored mines are similar in fashion but typically reside in the water column.

The United States currently utilizes the Mine Countermeasure Triad (MCM Triad) to counter the threat and presence of naval mines. The MCM Triad is comprised of MCM ships, Airborne MCM helicopters, and Explosive Ordnance Disposal Detachments (EOD). US Navy EOD divers are currently the only divers qualified to conduct underwater render safe or disposal procedures (RSP) on underwater hazardous devices. Other elements of the MCM Triad currently use underwater autonomous systems to neutralize naval mines but the precision, small working confinements, and unique nature of EOD operations has prevented EOD detachments from utilizing similar technology until recently.

Current technological advances make it possible for EOD personnel to conduct MCM operations utilizing portable underwater remotely operated vehicles to deliver explosive charges. Examples of these types of remotely operated vehicles include the VIDEORAY® Defender, SRS Fusion, and SEABOTIX® vLBV. Such explosive charges can be created by placing readily available demolition materials into containers that can hold bulk explosives or an explosive tool (such as linear shape charges or conical shape charges) and that can be placed for neutralizing, rendering safe, or detonating a naval mine.

Accordingly, a solution is needed that will allow EOD personnel to build an underwater counter charge or underwater shape charge using readily available explosive materials, such as C-4, which can be delivered by a small underwater remotely operated vehicle. Once assembled, a solution is needed to place and initiate an explosive charge without a diver having to enter the water, thereby reducing the risk and enhancing the response capabilities of MCM operations.

BRIEF SUMMARY OF THE INVENTION

The present invention is a configurable container that holds explosives or underwater explosive tools and can be positioned next to a bottom or moored mine either by using a small remotely operated vehicle or being emplaced by a diver.

It is an objective of this invention to serve as a containment system for bulk explosives that are detonated to over pressurize and crack a mine casing or to sympathetically detonate the bulk explosives contained within the underwater explosive device. The container can also be configured to contain an explosively formed penetrator or shape charge for precision oriented EOD operations.

It is a further objective of this invention to provide an underwater containment system that is non-ferrous in material to allow the container to be utilized against underwater explosive devices that are detonated by magnetic sensors.

It is still a further objective of the invention described herein to be quickly constructed utilizing readily available bulk explosives utilized by military and government entities responsible for the mine counter mission.

It is still another objective of this invention to provide a platform for housing numerous means for initiation including detonation cord and time delayed firing devices, or remotely initiating through an acoustic initiator or similar device.

It is yet still another objective of this invention to provide a means for a diver to secure the invention to the sea floor in the absence of a remotely operated vehicle.

It is yet another objective of the invention to utilize attachments to enable the system to attach to moored mines.

It is yet another objective of the invention to utilize an integration kit that enables the charge to integrate with and be delivered from a variety of underwater remotely operated vehicles.

It is yet another objective of the invention to provide the end user with the ability to add positive or negative buoyancy to the system to optimize flight performance of the remotely operated vehicle.

BRIEF DESCRIPTION OF THE DRAWINGS

The present invention is described in detail below with reference to the attached drawings and figures, wherein.

DETAILED DESCRIPTION OF THE INVENTION

Figure 1:
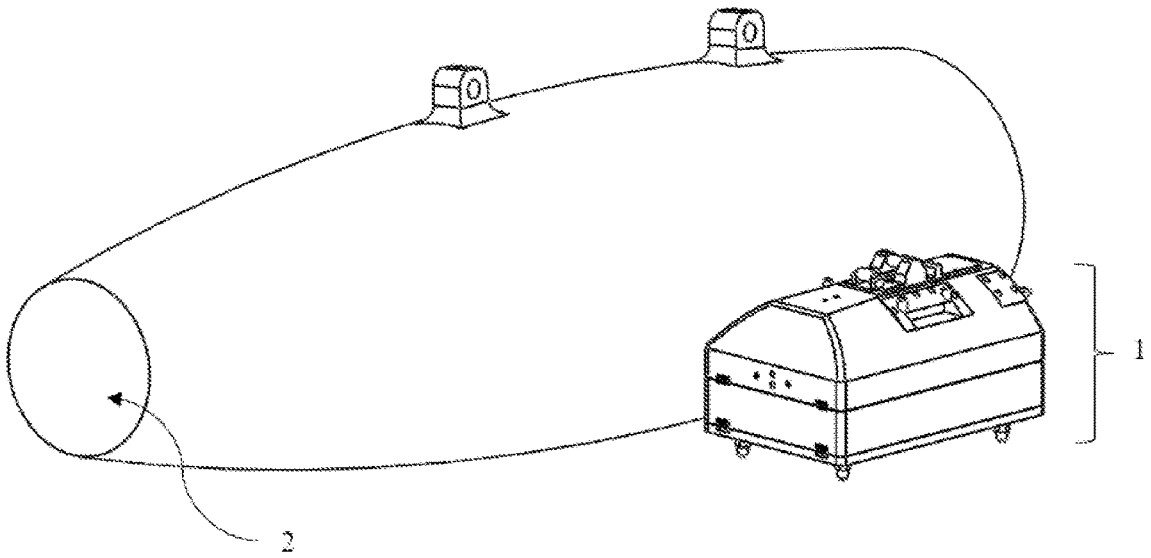
FIG. 1 is an illustration of the explosive container 1 when positioned for use against a bottom mine 2.

Referring now to the invention in more detail, in FIG. 1, there exists an explosive container 1. The explosive container 1 is used to neutralize and destroy sea mines, underwater improvised explosive devices, and other types of materialistic or hazardous targets. The explosive container 1 accomplishes the destruction of targets using a combination of heat and an underwater shock wave. Both are generated during the detonation of bulk explosives. Upon detonation, the underwater shock wave is capable of cracking and opening the container and even sympathetically detonating the explosive filler within the target. The explosive container 1 can either be placed in position next to the bottom mine 2 by a diver or delivered to the target via a small underwater remotely operated vehicle 40.

FIG. 1 shows the explosive container 1 positioned next to a bottom mine 2 and prepared for use. The positioning of the explosive container 1, which is positioned within immediate proximity of the bottom mine 2, is an extremely dangerous operation where extreme risk exists due to the possibility of the bottom mine 2 detonating. The invention, which enables explosives to be placed next to the bottom mine 2 using a remotely operated vehicle 40, reduces the risks to divers that would otherwise have to place explosive charges manually. To destroy a bottom mine 2, the explosive container 1 is negatively buoyant to ensure that the explosive container 1 remains on the sea floor without moving prior to detonation.

Figure 2:
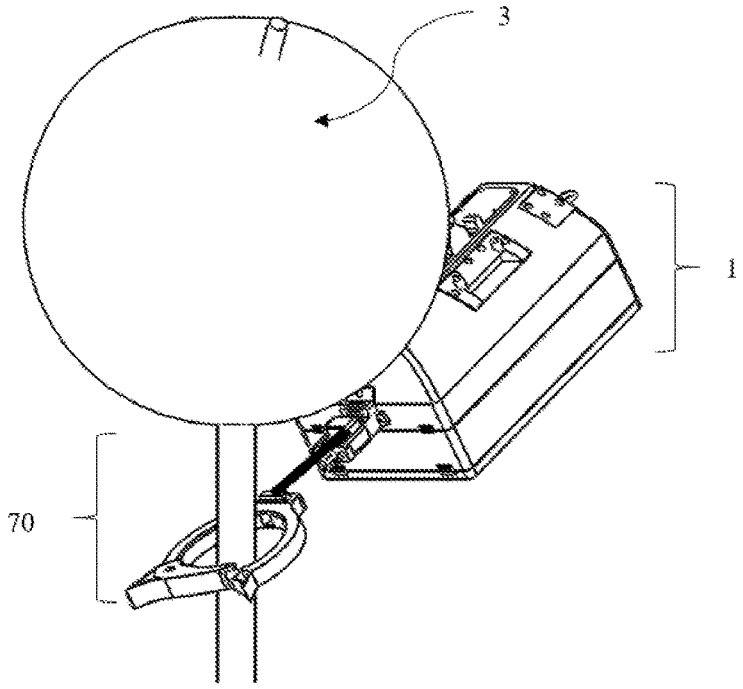
FIG. 2 is an illustration of the explosive container 1 when positioned for use against a moored mine 3.

FIG. 2 shows another use of the explosive container 1. In this image, the explosive container 1 is configured to be used to destroy a moored mine 3, or similar type of buoyant target. These types of targets typically have an anchor chain or cable which secures the moored mine 3 to the sea floor. To accomplish this type of operation, the explosive container 1 is equipped with a moored mine attachment system 70 that enables the explosive container 1 to be positioned next to the moored mine 3. This configuration requires that the explosive container 1 be positively buoyant so that it floats into position next to the moored mine 3.

Figure 3:
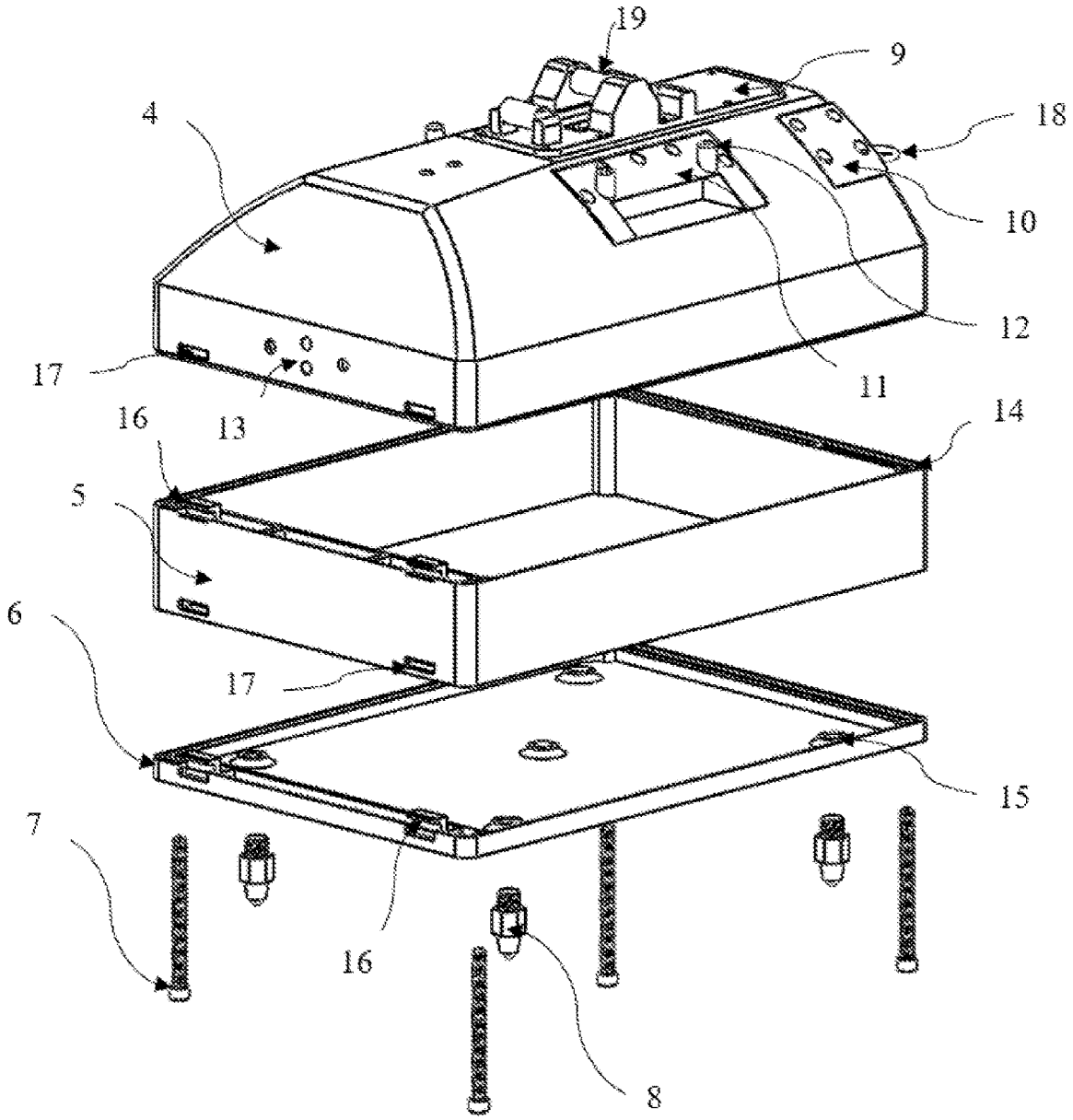
FIG. 3 is a perspective view of the explosive container 1.

FIG. 3 is a detailed illustration of the explosive container 1. The purpose of the explosive container 1 is to house a range of bulk explosives, such as a military demolition blocks, and to support underwater detonation operations. The explosive container 1 currently supports a range of explosive weight of 0.2 pounds up to 30 pounds. Examples of bulk explosives that can be used include Semtex-1A 500 gram block, M112 demolition blocks, and ½ pound TNT blocks to name a few.

Another purpose of the explosive container 1 is to support the use of shape charges and other demolition materials. To accomplish the wide range of explosives that might be used, the explosive container 1 is designed to support numerous types of initiation systems. Initiation systems that it supports includes non-electric and electric methods of initiation, detonation cord, and acoustic firing devices. Examples of these types of initiation systems include the M6, M7, MK 11 series of blasting caps, nonelectric shock tube, military detonation cord, and remote firing devices.

In addition to holding bulk explosives that may be used with a variety of initiation systems, the explosive container 1 is designed to be delivered by either a diver or remotely operated vehicle 40. This versatility enables the system to be used in the event that a remotely operated vehicle 40 is unavailable for use. To support these types of dive emplacement operations, a dive auger 60 is required to secure the explosive container 1 to the sea floor.

Lastly, the explosive container 1 is designed to be used for either bottom or moored type targets where the buoyancy is adjusted within the container to account for the position of the intended target.

FIG. 3 illustrates one embodiment of the explosive container 1 comprising an upper housing 4, an optional extension bracket 5 and a lower lid 6. In this example, the upper housing 4 has a rectangular footprint where the long sides curve, leading to a flat upper surface that is slightly angled. In other embodiments upper housing 4 has a square footprint or has a one-half cylindrical body. In all cases, upper housing 4 consists of interior and exterior walls. Beneath upper housing 4 is a hollow void that allows the insertion of bulk explosives or shape charges. Fillets at each surface interface are also present on upper housing 4 if needed or desired. The purpose of the shape of upper housing 4 in FIG. 3 is to provide hydrodynamic efficiencies for flying the explosive container 1 to the intended target. The hydrodynamic design also reduces the movement of the explosive container 1 when positioned on the sea floor to ensure the explosive container 1 remains in proximity of the target for situations where strong currents or surge are present.

The explosive container 1 and components may be made of non-ferrous materials to allow for use against magnetically influenced mines and may be made with high strength to weight ratio materials capable of withstanding high pressure that are present in deep-water operations. Examples of materials that may be used include resin-based plastics, carbon fiber, and other high strength materials. In addition to the hydrodynamic design of the explosive container 1, the features of the system have been designed to enhance the hydrodynamic performance of the invention and ultimately results in a reduction of the seismic signature of the explosive container 1 when in transit and when located in the vicinity of the target.

FIG. 3 includes a number of features and subcomponents required for the explosive container 1. These include the upper housing 4, the extension bracket 5, lower lid 6, threaded fasteners 7, spikes 8, optional robot integration plate 9, the strain relief mount 10, handles 11, bungee attachment extrusion 12, mooring attachment holes 13, thru holes 14, optional spike support holes 15, male connections 16, female connections 17, strain relief 18, and the latch rod 19.

The most top portion of the explosive container 1 consists of the upper housing 4. The upper housing 4 is the primary component of the explosive container 1 and supports components that include the robot integration plate 9, the strain relief mount 10, handles 11, and the mooring attachment holes 13. When connected, the upper housing 4 and lower lid 6 form a cavity within the explosive container 1. To provide a scalable munition load, the upper housing 4 is stacked on top of the optional extension bracket 5. This modular approach enables the explosive container 1 to carry various amounts of explosives while minimizing the negative hydrodynamic affects for smaller loads. Beneath the optional extension bracket 5 is the lower lid 6. The placement of extension bracket 5 between upper housing 4 and lower lid 6, increases the size of the cavity within the explosive container 1. The lower lid 6 is used to secure the container contents within the cavity.

The optional robot integration plate 9 is located on the top of the upper housing 4 and is used to connect the explosive container 1 to a remotely operated vehicle 40. Therefore, the optional robot integration plate 9 is only required when deploying the system using a remotely operated vehicle.

Located on each side of the upper housing 4 are handles 11. The handles 11 are designed to ease the handling of the system during loading procedures. On each of the top surfaces of the handles 11 there is a bungee attachment extrusion 12. These bungee attachment extrusions 12 are used to connect a bungee release system that is used for countering the weight of the explosive container 1 when configured on the remotely operated vehicle 40. This is done to provide enhanced robot flight performance. If not present and used, the remotely operated vehicle 40 could have degraded flight performance or even sink.

Located on the top of the upper housing 4 is also a strain relief mount 10 that is fixed to the upper housing 4. The purpose of the strain relief mount 10 is to connect a rope or line to the explosive container to enable the system to be retrieved should it be required. This is connected at the strain relief 18 as shown on the rear of the explosive container 1. The strain relief 18 is a rope that has a loop 36 in it, and which is anchored to the upper housing 4 using the strain relief mount 10.

When stacking the upper housing 4, the optional extension bracket 5, lower lid 6, and a series of male connections 16 are mated to the corresponding female connections 17. This ensures that each of the components is aligned and eases the assembly process for the end user. It should be noted that the optional extension bracket 5 is used to expand the volume of the explosive container 1 to support larger explosive loads. The optional extension bracket 5 is also used for moored configurations of the system to allow buoyancy compensation to be added to the charge. Adding buoyancy compensation enables the system to remain positively buoyant for moored targets.

To connect the upper housing 4, optional extension bracket 5, and the lower lid 6, threaded fasteners 7 are located at each of the corners of the lower lid 6. These threaded fasteners 7 enter and pass through the thru holes 14 located on the extension bracket 5. The threaded fasteners 7 then connect into a threaded receiver located on each of the corners of the upper housing 4 where they align with the thru holes 14 located on the optional extension bracket 5.

For bottom type sea mines 2, optional threaded spikes 8 may be fastened into the lower lid 6 through optional spike support holes 15 to assist with securing the explosive container 1 to the sea floor. By adding spikes 8, the explosive container 1 is able to withstand strong currents and ocean movements when released from the remotely operated vehicle 40. This works because the spikes 8 are driven into the sea floor by the weight of the explosive container 1 and the spikes 8 create additional anchoring points that serve to hold the explosive container 1 in position.

For moored type mines 3, a moored mine attachment system 70 is connected to the front of the upper housing 4 using the mooring attachment holes 13 in combination with standard fasteners.

Figure 4:
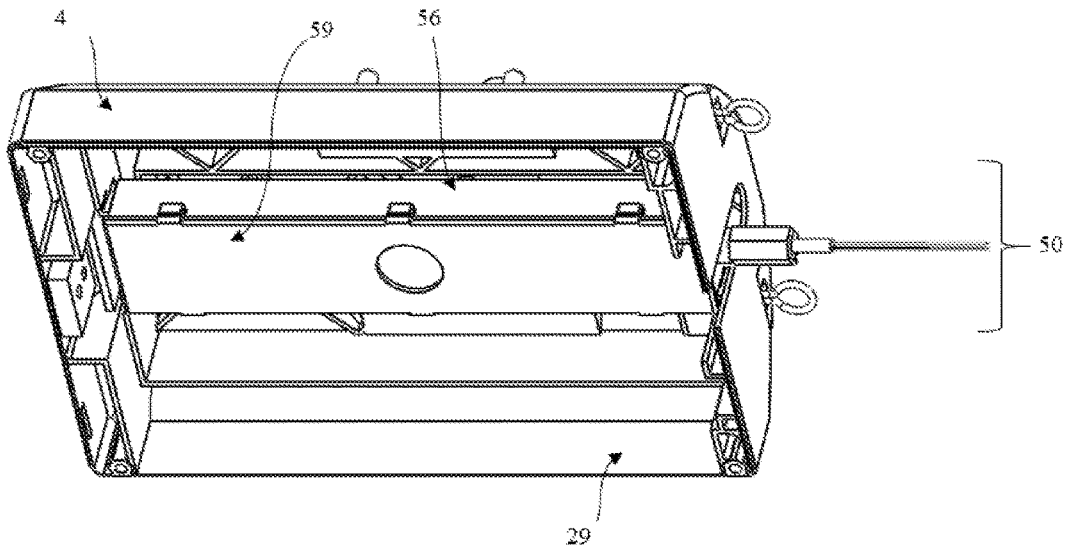
FIG. 4 is a bottom perspective view of the explosive container 1 illustrating the priming box 50.

FIG. 4 is a bottom perspective view of the upper housing 4 of explosive container 1. The image shows the internal configuration of the upper housing 4. The hollow cavity 29 located within the upper housing 4 is where the bulk explosive or explosive tools are located. To support initiation of the explosives, priming box 50 is inserted within the hollow cavity 29 such that the initiation system 51 and slotted top cap 52 pass through an opening or slot in upper housing 4 and extend outside the upper housing 4. The purpose of the priming box 50 is to support the initiation of bulk explosives using a range of systems including electrical and non-electric blasting caps, slap dets, remote firing systems, and detonation cord. The container is designed to hold a single military demolition block within the priming block housing 56 and sealed shut and fastened together with the priming block lid 59.

Figure 5:
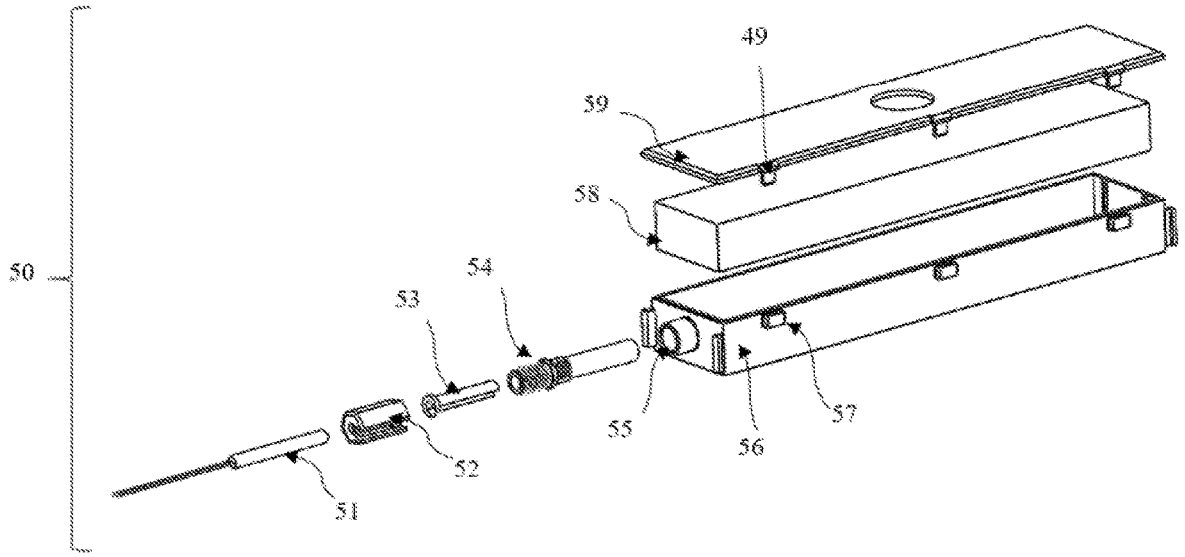
FIG. 5 is a perspective view of the priming box 50 and corresponding components.

FIG. 5 describes the priming box 50 in more detail where the priming block lid 59 and the priming block housing 56 are used to house the demolition block 58. To secure the demolition block 58 into position, a series of male clasps 49 located on the priming block lid 59 are inserted into corresponding female clasps 57 located on the priming block housing 56. Once secured, the demolition block 58 is inserted into the upper housing 4 and ready to be fitted with the initiation system 51.

FIG. 5 also features an initiation system 51 that is used to detonate the demolition block 58. This is done by inserting the threaded cap insert 54 into the demolition block 58 and securing the threaded cap insert 54 to the priming block housing 56 at the priming block orifice 55. With the threaded cap insert 54 attached to the priming block housing 56, the initiation system 51 can be inserted into the threaded cap insert 54. It is then held into position using a slotted top cap 52 within the priming block 50. An optional slotted receiver 53 is used for small length initiation systems 51 where the length of the blasting cap requires an adjustable component. It should be noted that if a remote firing system is used then the remote firing system may thread directly into the priming block housing 56 using the same priming block orifice 55.

Figure 6:
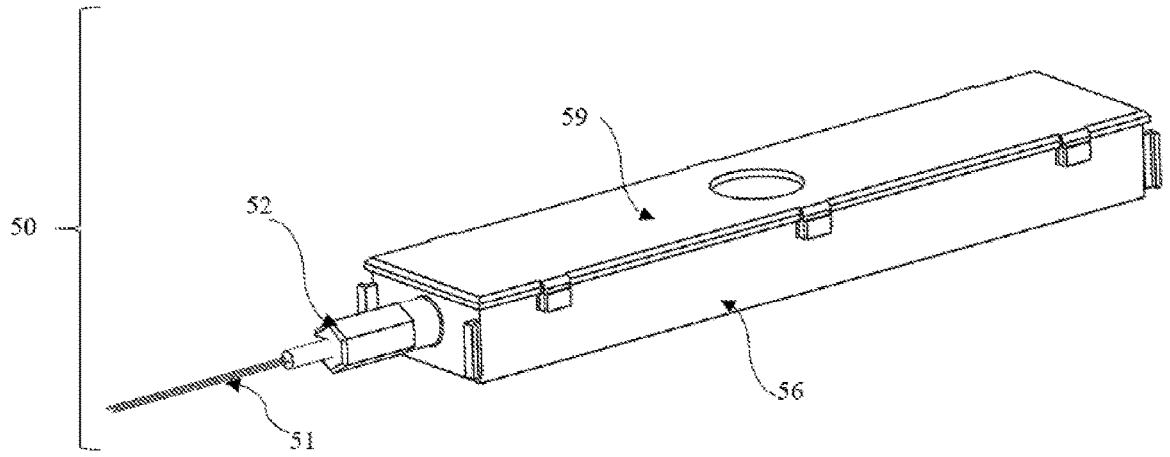
FIG. 6 is a perspective view of the priming box 50 when prepared for use.

FIG. 6 illustrates the priming box 50 when it is prepared for use. The initiation system 51 is inserted into the threaded cap insert 54 which is pushed into the demolition block 58. The blasting cap may then be inserted into the threaded cap insert 54 and is held into position using the slotted receiver 53 and slotted top cap 52.

Figure 7:
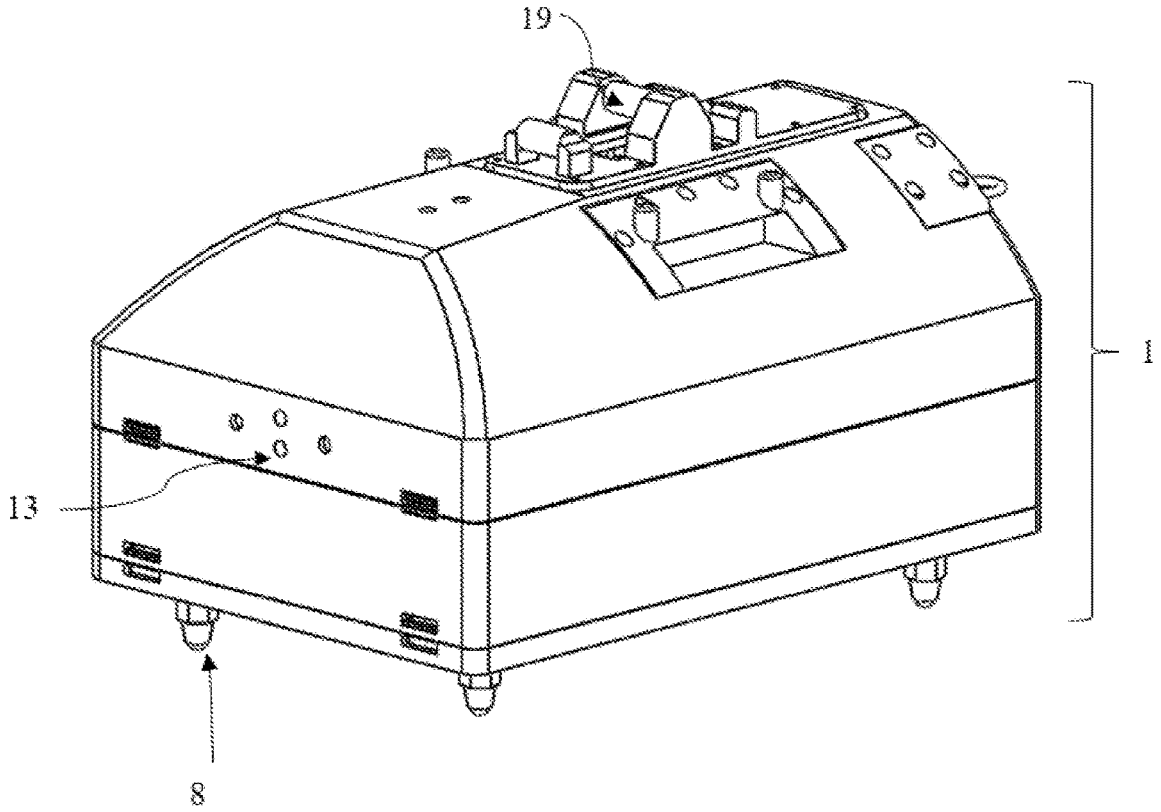
FIG. 7 is another perspective view of the explosive container 1 when assembled for use.

FIG. 7 is a perspective view of the explosive container 1 when secured and prepared for use. The optional spikes 8 are included to assist with using the system to support operations for use against bottom mines. Also shown are the mooring attachment holes 13 which supports the use of a moored attachment 70 (not shown) that is used for moored mine operations. Also shown is the latch rod 19 that connects the explosive container 1 to the remotely operated vehicle.

Figure 8:
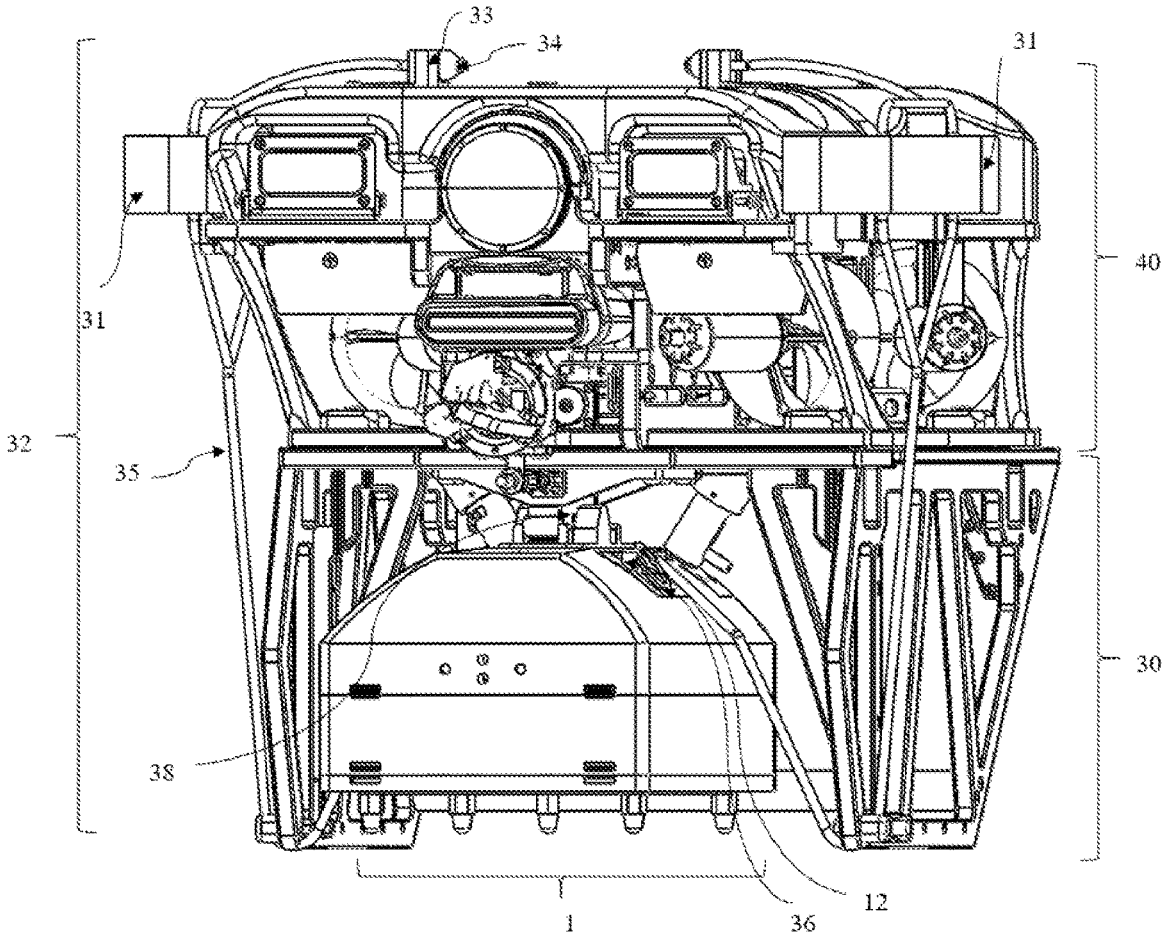
FIG. 8 is an engineering drawing of the explosive container 1 when positioned on a small underwater remotely operated vehicle 40 and prepared for delivery against a bottom mine 2.

FIG. 8 is a perspective view of the explosive container 1 when integrated beneath a remotely operated vehicle 40. The explosive container 1 is integrated to the remotely operated vehicle 40 using an integration skid 30 that connects to the bottom of the remotely operated vehicle 40. The purpose of the integration skid 30 is to secure and release the explosive container 1, to protect the explosive container 1 when in transit to the target, and to support a bungee release system 32. The integration skid 30 is primarily manufactured from high density polyethylene and/or other high strength materials that can withstand the pressure at depths nearing 1200 feet of salt water.

FIG. 8 also shows the components of the bungee release system 32. These components include the floats 31, a grooved fitting 33, a ball fitting 34, and bungee cord 35. The purpose of the bungee release system 32 is to provide buoyancy compensation to the remotely operated vehicle 40 to counter the weight of the explosive container 1 when integrated to the system. Therefore, the bungee release system 32 is only required when the explosive container 1 is configured for use against a bottom type of target when it is negatively buoyant, and the system separates from the remotely operated vehicle 40 upon release of the explosive container 1.

The bungee release system 32 consists of a bungee cord 35 that is secured to a float 31. On one end of the bungee cord is a ball fitting 34. On the opposite end of the bungee cord 35 is a loop 36. The ball fitting 34 is secured within the grooved fitting 33 located on top of the remotely operated vehicle 40. The grooved fitting 33 connects to the ball fitting 34 when there is tension in the bungee cord 35 but enables the ball fitting 34 to slip out when tension is released. On the other end of the bungee cord 35, a loop 36 is secured to the explosive container 1. This loop 36 is secured to the bungee attachment extrusion 12 located on the handle 11.

The positioning of the floats 31 near the top of the remotely operated vehicle 40 is important because the positioning provides metacenter optimization and enhances in water performance of the remotely operated vehicle 40. These same floats 31 are intended to be jettisoned from the remotely operated vehicle 40 upon release of the explosive container 1. This occurs when the explosive container 1 is released and falls from the remotely operated vehicle 1. The bungee cord 35 also pulls the explosive container 1 in a downward direction away from the remotely operated vehicle 40 until the loop 36 comes free of the bungee attachment extrusion 12. At this point the ball fitting 34 comes free of the grooved fitting 33 and the buoyancy compensation system 32 floats to the surface. This separation of the floats 31 and bungee release system 32 ensures that the remotely operated vehicle returns to a stabilized configuration after the explosive container 1 release.

A latch mechanism 38 is used to secure and release the explosive container 1 to the remotely operated vehicle 40. The latch mechanism 38 secures the explosive container 1 in place around the latch rod 19. The latch mechanism 38 releases the explosive container 1 when the latch mechanism 38 is activated. This is done by the operator using the actuator inputs on the operator control console.

Figure 9:
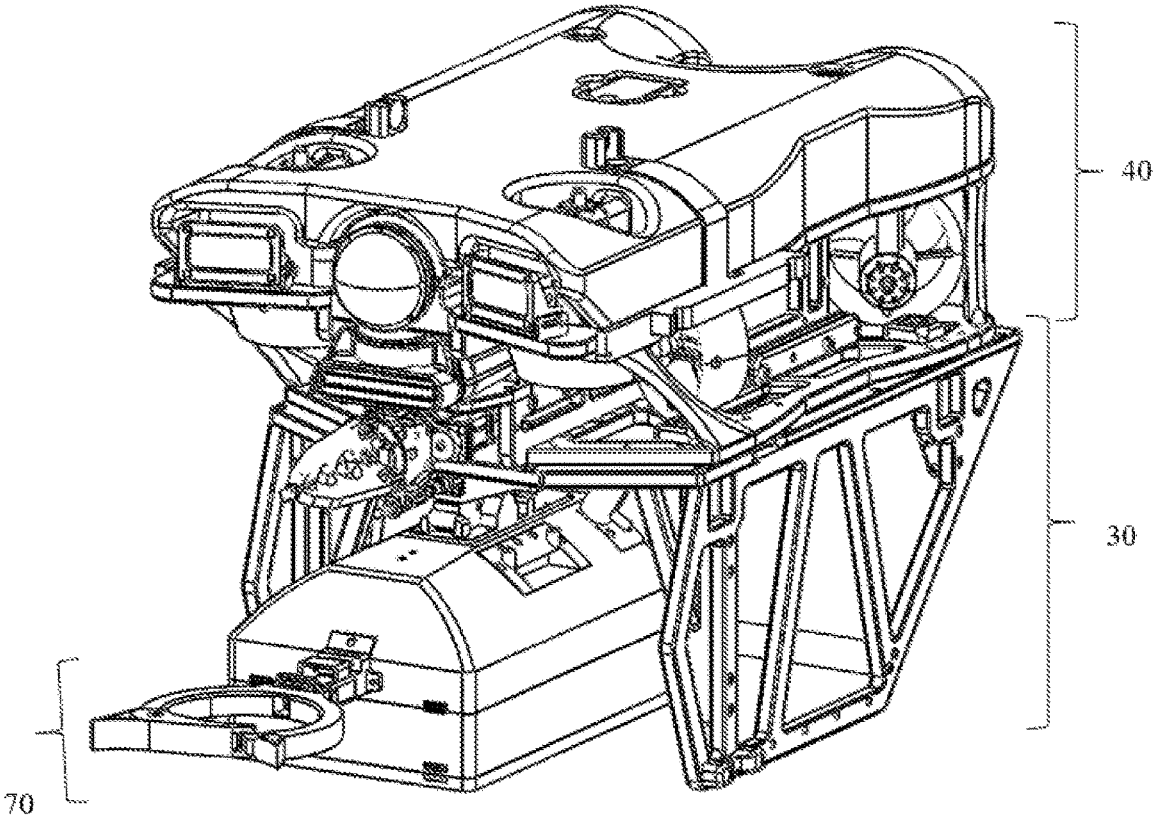
FIG. 9 is an engineering drawing of the explosive container 1 when positioned on a small underwater remotely operated vehicle 40 and prepared for delivery against a moored mine 3.

FIG. 9 is an engineering drawing of the remotely operated vehicle 40 with the explosive container 1 integrated within the skid assembly 30. This configuration is used when the intended target is a moored mine 3. A moored mine attachment system 70 is also used with this combination.

Figure 10:
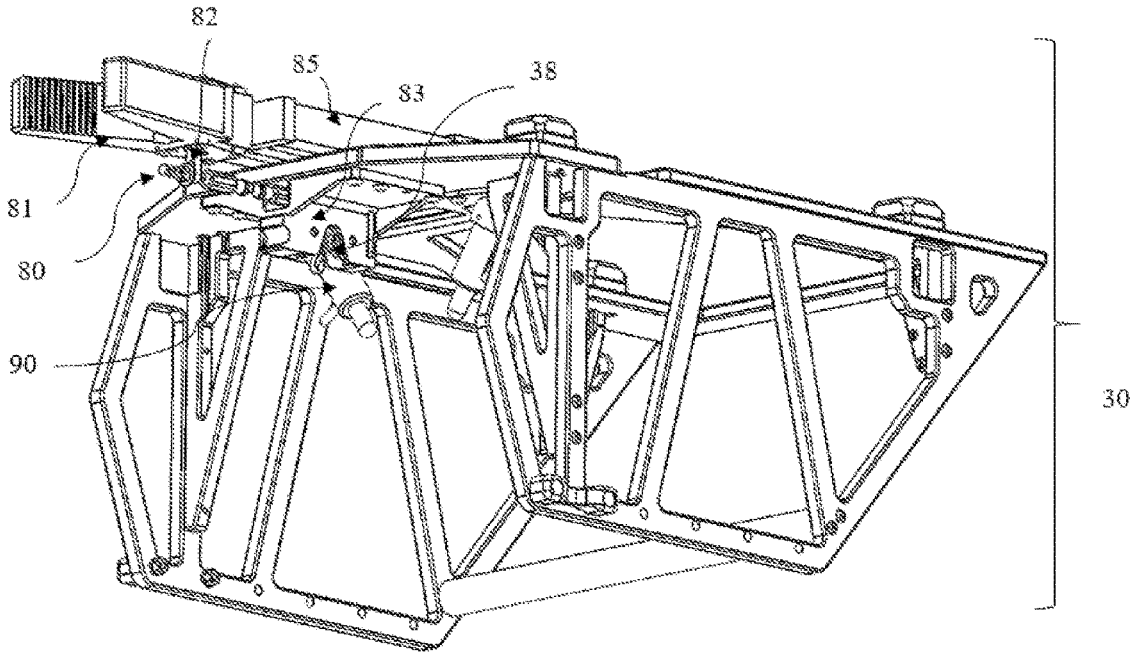
FIG. 10 is an engineering drawing of the integration skid 30 showing the subsystems used to secure and release the explosive container 1.

FIG. 10 is a perspective view of the integration skid 30 and components relating to the integration and separation of the explosive container 1. The drawing includes the mechanical linkage 80, gripper 81, eye end 82, latch housing 83, and the linear actuator 85. The drawing also shows the push rod assembly 90.

To secure and release the explosive container 1 from the remotely operated vehicle 40, the system uses the linear actuator 85. The linear actuator 85 is powered from the remotely operated vehicle 40 and results in a linear motion that is used to open and close the gripper 81. The explosive container 1 uses this motion to actuate a latch mechanism 38 located within the latch housing 83. This is done by connecting mechanical linkage 80 from the latch mechanism 38 to the gripper interface via an eye end 82.

Figure 11:
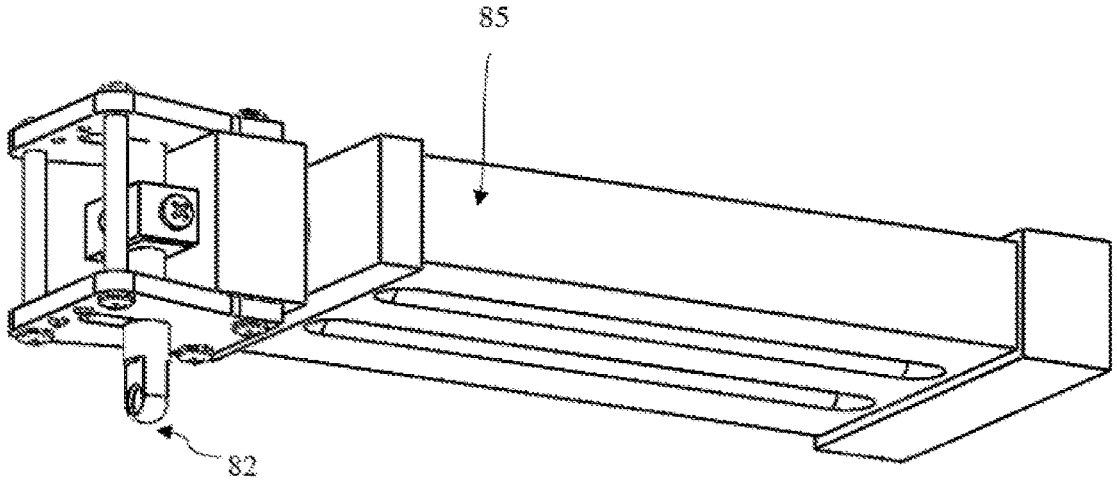
FIG. 11 is an engineering drawing of the linear actuator 85 in the closed position when the explosive container 1 is secured to the integration skid 30.
Figure 12:
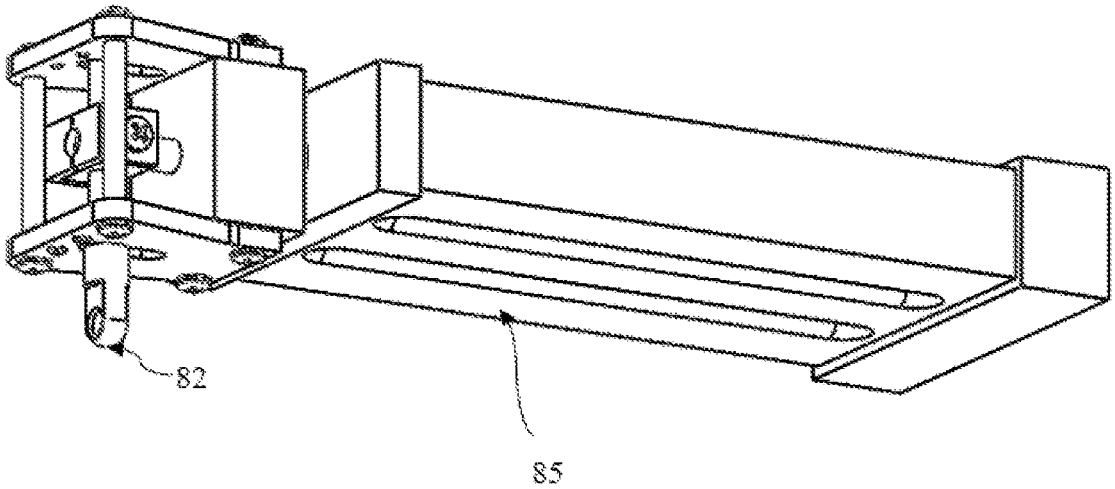
FIG. 12 is an engineering drawing of the linear actuator 85 in the open position when the explosive container 1 is released from the integration skid 30.

FIG. 11 and FIG. 12 are engineering drawings of the linear actuator 85. FIG. 11 demonstrates the position of the eye end 82 when the gripper 81 is closed. In the closed position, the explosive container 1 remains on the remotely operated vehicle 40. FIG. 12 is an image of the linear actuator 85 in the open position. The forward movement of the linear actuator 85 causes the eye end 82 to move. This movement is translated to the latch mechanism 38 via the mechanical linkage 80 thereby causing the latch mechanism 38 to open.

Figure 13:
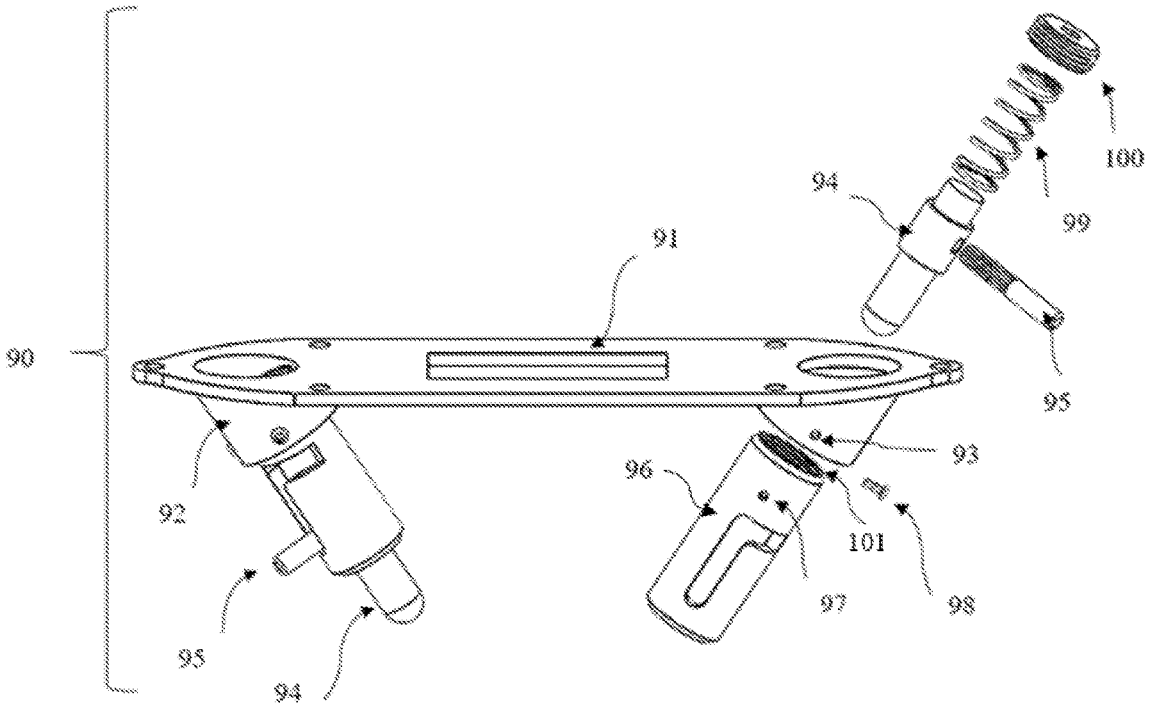
FIG. 13 is a perspective view of the push rod assembly 90 used in the separation of the explosive container 1 form the integration kit 30.

FIG. 13. is an engineering drawing of the push rod assembly 90. The purpose of the push rod assembly 90 is to stabilize the explosive container 1 when the explosive container 1 is attached to the integration skid 30 during transit. Another purpose of the push rod assembly 90 is to assist with separating the explosive container 1 from beneath the integration skid 30 upon release from the remotely operated vehicle 40. For this reason, it is important that the push rod assembly 90 be positioned near the rear half of the explosive container 1 to rotate the explosive container 1 away from the remotely operated vehicle 40 upon separation.

Also shown in FIG. 13 are the some of the components of the push rod assembly 90. These include the push plate 91, rod holder 92, and fastener hole 93. The purpose of the push plate 91 is to attach to the integration skid 30 and to serve as the support bracket for the push rod assembly 90. One surface of the push plate 91 is flat to mate to the integration skid 30. On the opposite surface, there exists two rod holders 92 that are cylindrical in shape with thin walls. The rod holders 92 are angled and used to hold the push tubes 96. To attach the rod holder 92 and push tubes 96, a series of threaded fastener holes 93 are located around the rod holder 92. The threaded fastener holes 93 are concentrically aligned with the push tube thru holes 97. Small set screws 98 are used to connect the push tube 96 onto the rod holder 92.

Within the push tubes 96 are a series of components. These include the push rod 94, peg 95, spring 99, and threaded cover 100. The combination of these components is used to thrust the explosive container 1 away from the integration skid 30. This is done using spring compression. These components insert into the push tubes 96 and are secured within the push tubes 96 using the threaded cover 100. This is done by screwing the threaded cover 100 onto the internal threads 101 of the push tubes 96.

FIG. 13 shows the position of the push rod 94 when installed within the push tubes 96 and where the spring 99 is uncompressed. To compress the spring 99, the operator simply pulls the peg 95 upward and rotates the peg 95 into a slotted feature located on the push tube 96. This compresses the spring 99 and enables the operator to load the explosive container 1. Once loaded, the operated then rotates the pegs 95 to allow the spring 99 to exert force on the upper housing 4 of the explosive container 1. When the explosive container 1 is released from the remotely operated vehicle 40 then the push rod 94 exerts a force on the upper housing 4 thereby moving the explosive container 1 down and away from the remotely operated vehicle 40.

Figure 14:
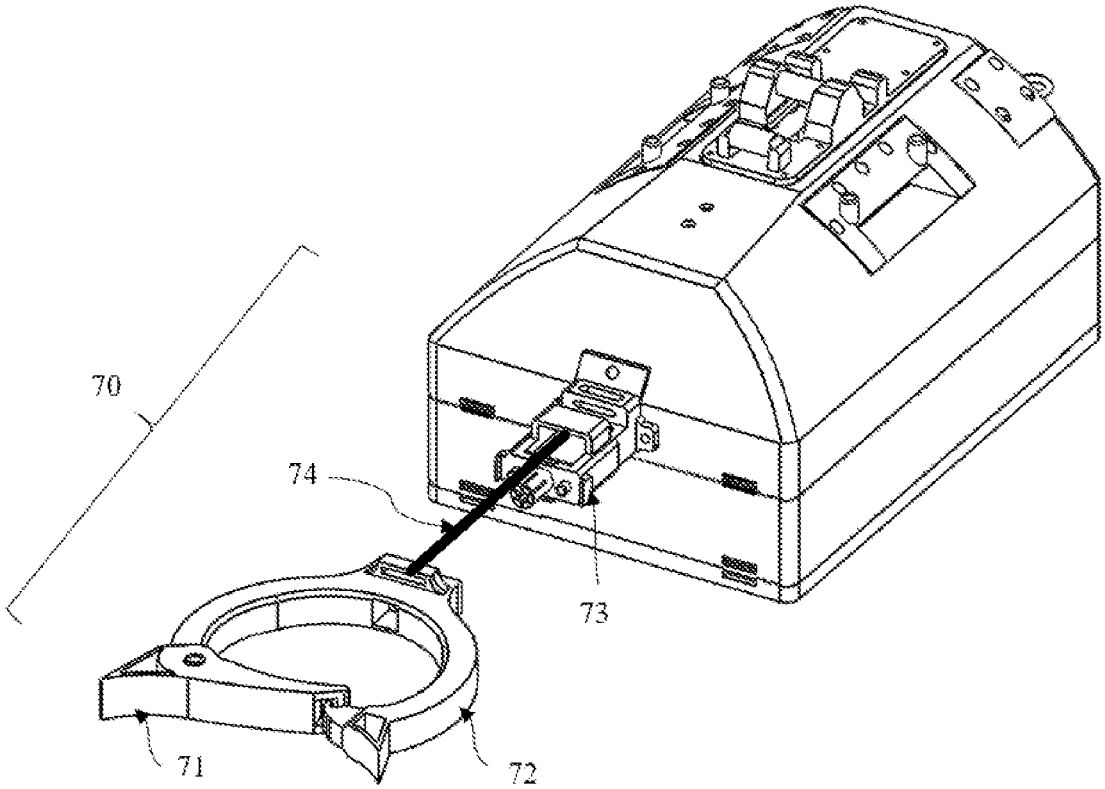
FIG. 14 is a perspective view of the moored mine attachment system 70 that is used to secure the explosive container 1 to a moored mine 3.

FIG. 14 illustrates additional details of the optional moored mine attachment system 70. The moored mine attachment system 70 is configured to the explosive container 1 when the explosive container 1 is intended to be used against a moored mine 3. The purpose of the moored mine attachment system 70 is to connect the explosive container 1 to an anchor chain or mooring cable attached to a moored mine 3. Doing so enables the explosive container 1 to float into position upon release from the remotely operated vehicle 40. The primary components of the moored mine attachment system 70 includes the gate 71, hook 72, hook attachment 73, and the webbing 74.

The moored mine attachment system 70 uses a hook 72 in combination with a spring-loaded gate 71 to secure the system around a mooring cable or chain. The hook 72 is connected to the hook attachment 73 which is fastened to the explosive container 1. A webbing strap between the hook 72 and hook attachment 73 connects the two components and allows the explosive container 1 to float up the anchor chain or mooring line upon separation from the remotely operated vehicle 40.

Figure 15:
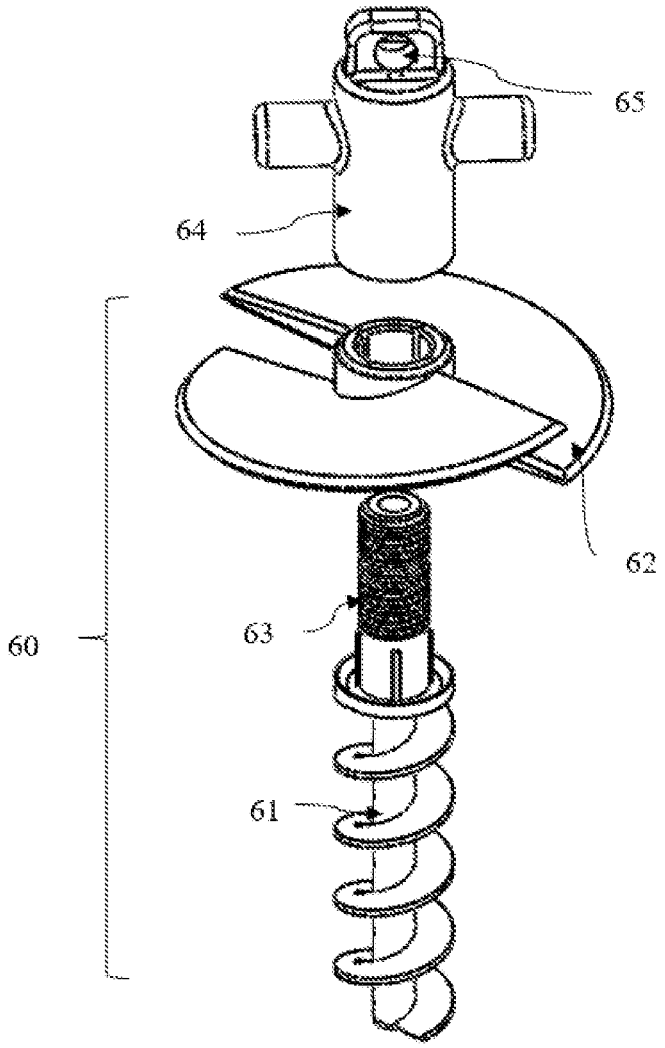
FIG. 15 is a perspective view of the dive auger 60 unassembled and configured for diver transport prior to use.

FIG. 15 shows the dive auger 60 and associated components that include the rod 61, auger 62, threaded rod 63, the handle 64, and the eyelet 65. The dive auger 60 is used by divers to secure the explosive container 1 to the sea floor. This is done to ensure that the explosive container 1 remains in the proper orientation and proper distance away from a bottom mine 2 even in the presence of ocean currents or surge. The advantage of the dive auger 60 is that it is designed to be compact thereby allowing the diver to place the device within a bag or even attach it to their leg during the approach to the bottom mine 2. When the diver arrives at the target, the dive auger 60 is assembled and inserted into the sea floor. This is done with a threading type motion and the systems works in sand, mud, silt, and mixed bottom types.

Figure 16:
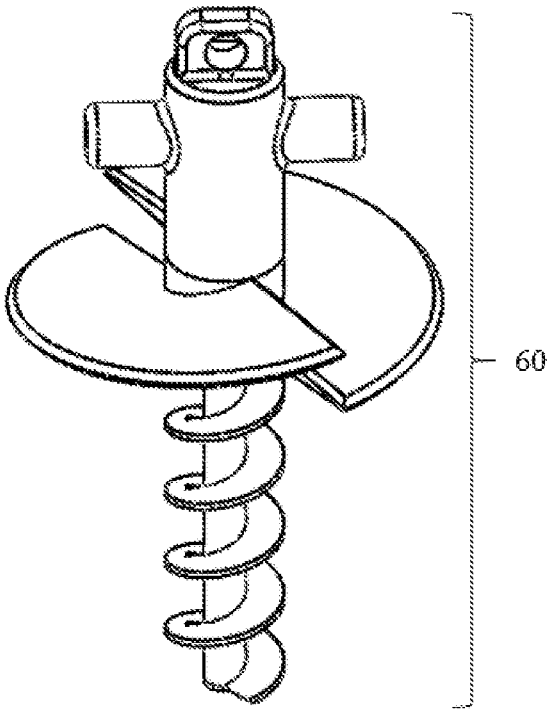
FIG. 16 is a perspective view of the dive auger 60 assembled for use to secure the explosive container 1 to the seafloor.

To assemble the dive auger 60, as shown in FIG. 16, the diver places the auger 62 concentrically over the rod and lowers it into position. Once in position, the diver then threads the handle 64 over the threaded rod 63 portion of the rod 61. When assembled, the diver can then turn the device into the seafloor. A tether, such as a line or rope, is then connected between the strain relief 18 located on the explosive container 1 and the eyelet 65 located on the handle 64 of the dive auger 60. The dive auger and tether comprise the dive auger attachment system.

The advantages of the present invention include, without limitation, the safety afforded a diver by utilizing remote means to neutralize, render safe, or detonate an underwater mine or similar underwater explosive device. The ability to place the explosive container 1 using a small remotely operated vehicle reduces the risks of injuring or killing a diver who would otherwise be required to place the charge and having the explosive device detonating while a diver is in the water. In addition, the emplacement of the explosive container 1 utilizing a remote operated vehicle reduces the risks of diver related mishaps associated with such diving operations. The versatility and compact size of the explosive container 1 allows personnel to conduct demining operations from small platforms such as a small boat. The explosive container 1 can utilize a shape charge, explosively formed penetrator, or bulk explosives to meet the requirements of the intended disposition of the naval mine. Lastly, the ability to utilize demolition materials that are widely available enhances versatility for personnel responsible for conducting demining operations. The present invention allows operators to use demolition materials that are common and that do not require additional administrative documentation for expending, storing, or transporting between operations and magazine facilities. As such, lower costs are associated with utilizing a shell type system that requires minimal demolition materials to be added.

In summary, the present invention is an underwater container to house explosives and explosive tools that can be deployed on bottom mines, and moored and underwater hazardous explosive devices in order to neutralize, render safe, flood, or detonate the intended target. The explosive container 1 may also be used to conduct any demolition operations where placement by an ROV is beneficial. These examples may include boring or mining operations, environmental reef demolition operations, or obstacle removal.

Operation of Device

To utilize the explosive container 1, the end user first determines whether or not the target is located on the sea floor or if the intended target is moored.

For targets located on the ocean floor, the end user loads bulk explosives or an explosive tool into the hollow cavity 29 of the explosive container 1. This is done by first placing a demolition block 58 within the priming box 50. The priming box 50 is then inserted into the hollow cavity 29 of the upper housing 4 of the explosive container 1. Additional bulk explosives are then added to the explosive container 1 as necessary. If additional bulk explosives are required, then an optional extension bracket 5 can be used. With the explosive container 1 filled, the end user connects the lower lid 6 onto upper housing 4 or the optional extension bracket 5 and secures the system by using the threaded fasteners 7 to connect the lower lid 6, upper housing 4 or optional extension bracket 5, and lower lid 6 together.

Once assembled, the initiation system 51 is added to the explosive container 1. This is done by inserting the threaded cap insert 54 into the demolition block 58 using the priming block orifice 55. Once inserted and threaded onto the priming box 50, the initiation system 51 is slid into the threaded cap insert 54. The initiation system 51 is then secured in place using a slotted top cap 52. If the initiation system 51 is a smaller diameter system, then a slotted receiver 53 can be used to secure the initiation system 51 into the demolition block 58.

The buildup of the explosive container 1 is similar when using an explosive tool such as a linear shape charge or conical shape charge. When using these types of explosive tools, the priming box 50 is not required. Instead, the linear shape charge or similar explosive tool is inserted into the hollow cavity 29 of the upper housing 4 of the explosive container 1. To install the initiation system 51 into the system, standard demolition techniques may be used for the specific explosive tool. Once the initiation system 51 is inserted into the explosive tool, the system can be connected to the strain relief 18 to ensure the initiation system 51 remains in place in the event that tension is placed on the initiation system 51.

The explosive container 1 is then integrated onto the remotely operated vehicle 1 using the integration skid 30. To accomplish this, the end user aligns the latch rod 19 located on the upper housing 4 of the explosive container 1 with the latch mechanism 38 located within the latch housing 83. The latch mechanism 38 will lock into place when the latch rod 19 is in position. The gripper 81 is kept closed during this integration process.

To offset the weight of the explosive container 1, a bungee release system 32 is added. This provides buoyancy to enable the remotely operated vehicle 40 to fly underwater without detriment in flight. To integrate the bungee release system 32, the ball fitting 34 located at one end of the bungee cord 35 is connected to the top of the remotely operated vehicle 40 using the grooved fitting 33. The other end of the bungee cord 35 is fitted with a loop end 36 that is placed around the bungee attachment extrusion 12.

With the system configured, the remotely operated vehicle 40 is placed in the water, flown to the target and releases the explosive charge 1 via the bungee release system 32. The remotely operated vehicle 40 is then able to validate the shot placement and return to the operator to support continued operations.

For moored targets, the explosive container 1 is only loaded using the upper housing 4 of the system. This is done using the same priming box 50 technique as previously explained in combination with demolition blocks 58. The extension bracket 5 is then added to the upper housing 4 and buoyancy is added. The moored mine attachment system 70 is connected to upper housing 4 via the hook attachment 73 and mooring attachment holes 13 prior to securing the system closed with the lower lid 6. Once the explosive container 1 is ready, the remotely operated vehicle 40 is flown toward the target. The operator uses the sonar and video of the remotely operated vehicle 40 to align the moored mine attachment system 70 with the anchor chain or mooring line. The gate 71 is pushed against the anchor chain or mooring line and the gate 71 swings open thereby capturing the anchor chain or mooring line within the hook 72. The operator then opens the gripper 81 to release the explosive container 1 from the integration assembly 30. With the hook 72 securely fastened to the anchor chain or mooring line, the explosive container 1 moves in an upward motion due to buoyancy forces. At the same time, the hook 72 separates from the explosive container 1 at the hook attachment 73. Webbing 74 then connects the hook 72 to the hook attachment 73. The use of the webbing 74 allows the explosive container 1 to float to a desired height next to the intended target. Therefore, the webbing 74 is modified by the end user depending on the target.

Lastly, the explosive container 1 may be used by a diver. In these circumstances, the diver places the explosive container 1 at the proper distance away from the target and places a dive auger 60 into the sea floor. A line or rope is then connected between the dive auger 60 and the explosive container 1. This is done so that the explosive container 1 remains in place in the event of strong currents or surge.

What is claimed:

1. An explosive container, comprising:

(a) an upper housing comprising at least one through hole on one side of the upper housing and an opening or open slot on the opposite side;

(b) a lower lid wherein the upper housing and lower lid define a cavity;

(c) a priming box located within the cavity and extending through the opening or open slot of the upper housing; and (d) moored mine attachment system comprising (i) gate;

(ii) a hook;

(iii) webbing; and (iv) a hook attachment.

2. The explosive container of claim 1, wherein the upper housing further comprises:

(a) at least one handle with at least one bungee attachment extrusion;

(b) at least one strain relief mount;

and (c) at least one strain release.

3. The explosive container of claim 2, further comprising a robot integration plate, wherein the robot integration plate comprises a latch rod.

4. The explosive container of claim 1, wherein the priming box comprises:

(a) an initiation system;

(b) a slotted top cap;

(c) a cap insert; a priming block housing with an orifice at one end;

(d) an explosive; and (e) a priming block lid.

5. A method of rendering safe a moored mine comprising:

(a) attaching the moored mine attachment system of the explosive container of claim 1 to the at least one through hole of the upper housing of the explosive container of claim 1;

(b) loading an explosive into the priming box of the explosive container of claim 1;

(c) inserting the priming box into the cavity of the explosive container of claim 1;

(d) inserting buoyancy into the cavity of the explosive container of claim 1

(e) attaching the bottom lid to the upper housing of the explosive container of claim 1 to form a completed explosive container;

(f) connecting the moored mine attachment system of the explosive container of claim 1 to an anchor chain or mooring of the moored mine; and (g) initiating explosion of the explosives.

6. The method of rendering safe a moored mine according to claim 5, further comprising (i) attaching the completed explosive container to an integration skid comprising a mechanical linkage, a gripper, a latch mechanism, a latch housing, a linear actuator, and a push rod assembly;

(ii) attaching the integration skid to a remotely operated underwater vehicle;

(iii) flying the remotely operated underwater vehicle to a moored mine; and (iv) releasing the completed explosive container from the integration skid, wherein steps (i) to (ii) are completed after step(e) and step (iv) is completed after step (f).

7. The explosive container according to claim 1, further comprising an extension bracket, wherein the upper housing, extension bracket, and lower lid define a cavity.

8. A method of rendering safe a moored mine comprising:

(a) attaching the moored mine attachment system of the explosive container of claim 7 to the at least one through hole of the upper housing of the explosive container of claim 7;

(b) loading an explosive into the priming box of the explosive container of claim 7;

(c) inserting the priming box into the cavity of the explosive container of claim 7;

(d) inserting buoyancy into the cavity of the explosive container of claim 7;

(e) attaching the bottom lid to the extension bracket of the explosive container of claim 7 to form a completed explosive container;

(f) connecting the moored mine attachment system of the explosive container of claim 7 to an anchor chain or mooring of the moored mine; and (g) initiating explosion of the explosives.

9. The method of rendering safe a moored mine according to claim 8, further comprising (i) attaching the completed explosive container to an integration skid comprising a mechanical linkage, a gripper, a latch mechanism, a latch housing, a linear actuator, and a push rod assembly;

(ii) attaching the integration skid to a remotely operated underwater vehicle;

(iii) moving the remotely operated underwater vehicle to a moored mine; and (iv) releasing the completed explosive container from the integration skid, wherein steps (i) to (iii) are completed after step (e) and step (iv) is completed after step (f).

10. The explosive container according to claim 7, wherein the priming box further comprises a slotted receiver.

11. The explosive container according to claim 1, wherein the priming box further comprises a slotted receiver.

* * * * *